US008678579B2

(12) United States Patent
Toya

(10) Patent No.: US 8,678,579 B2
(45) Date of Patent: Mar. 25, 2014

(54) IMAGE RECORDING DEVICE AND IMAGE RECORDING METHOD

(75) Inventor: Akihiro Toya, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 291 days.

(21) Appl. No.: 13/223,431

(22) Filed: Sep. 1, 2011

(65) Prior Publication Data

US 2012/0062674 A1 Mar. 15, 2012

(30) Foreign Application Priority Data

Sep. 10, 2010 (JP) ..... 2010-203215

(51) Int. Cl.
*B41J 2/01* (2006.01)

(52) U.S. Cl.
USPC ..... 347/104; 347/102

(58) Field of Classification Search
USPC ..... 347/104
See application file for complete search history.

(56) References Cited

U.S. PATENT DOCUMENTS

2010/0141726 A1* 6/2010 Kawakami et al. ..... 347/102

FOREIGN PATENT DOCUMENTS

JP 08-197799 A 8/1996

* cited by examiner

*Primary Examiner* — Matthew Luu
*Assistant Examiner* — Tracey McMillion
(74) *Attorney, Agent, or Firm* — Global IP Counselors, LLP

(57) ABSTRACT

An image recording device includes a suction part and a control part. The suction part is configured to suction a medium on a medium support part via suction holes and has a negative pressure chamber communicating with the suction holes and at least two air-blowing parts whereby air inside the negative pressure chamber is discharged and negative pressure is generated in the negative pressure chamber, the air-blowing parts being attached at different positions on an outer surface of the negative pressure chamber. The control part is configured to switch between a first mode in which a suction force of the suction part on the medium is set to a first suction force and a second mode in which the suction force is set to a second suction force lower than the first suction force. The control part is configured to stop one of the air-blowing parts in the second mode.

7 Claims, 6 Drawing Sheets

IMAGE RECORDING DEVICE AND IMAGE RECORDING METHOD

CROSS-REFERENCE TO RELATED APPLICATIONS

This application claims priority to Japanese Patent Application No. 2010-203215 filed on Sep. 10, 2010. The entire disclosure of Japanese Patent Application No. 2010-203215 is hereby incorporated herein by reference.

BACKGROUND

1. Technical Field

The present invention relates to an image recording device and an image recording method.

2. Related Art

A platen (medium support) for supporting a medium is provided to ink jet printers and the like, which are examples of image recording devices, so that the medium on which the image is printed is placed at a fixed orientation with respect to the head that discharges the ink (e.g., Japanese Laid-Open Patent Publication No. 8-197799).

SUMMARY

For example, there are printers in which suction holes are provided in the platen and the medium is suctioned from the suction holes so that the medium on the platen is held in a fixed position at the time of printing. However, conveyance is impeded if the suction force on the medium is too strong when the medium is to be conveyed. Thus, it is desirable for the suction force on the medium to be reduced at the time when the medium is conveyed. However, any extra time required to reduce the suction force on the medium increases the overall printing action time.

The present invention was contrived in view of these circumstances, it being an object of the invention to reduce, as much as possible, the time required for reducing the suction force on the medium.

An image recording device according to one aspect of the present invention includes a recording part, a conveying part, a medium support part, a suction part and a control part. The recording part is configured and arranged to record an image on a medium. The conveying part is configured and arranged to convey the medium. The medium support part is configured and arranged to support the medium on a support surface provided with openings of suction holes. The suction part is configured and arranged to suction the medium supported on the medium support part via the suction holes, the suction part having a negative pressure chamber communicating with the suction holes and at least two air-blowing parts whereby air in an interior of the negative pressure chamber is discharged and a negative pressure is produced inside the negative pressure chamber, the air-blowing parts being attached at different positions on an outer surface of the negative pressure chamber. The control part is configured to switch between a first mode in which a suction force of the suction part on the medium is set to a first suction force and a second mode in which the suction force is set to a second suction force that is lower than the first suction force. The control part is configured to stop one of the air-blowing parts in the second mode.

Other features of the present invention will be clarified by the specification and descriptions in reference to the attached drawings.

BRIEF DESCRIPTION OF THE DRAWINGS

Referring now to the attached drawings which form a part of this original disclosure.

DETAILED DESCRIPTION OF EXEMPLARY EMBODIMENTS

Figure 1:
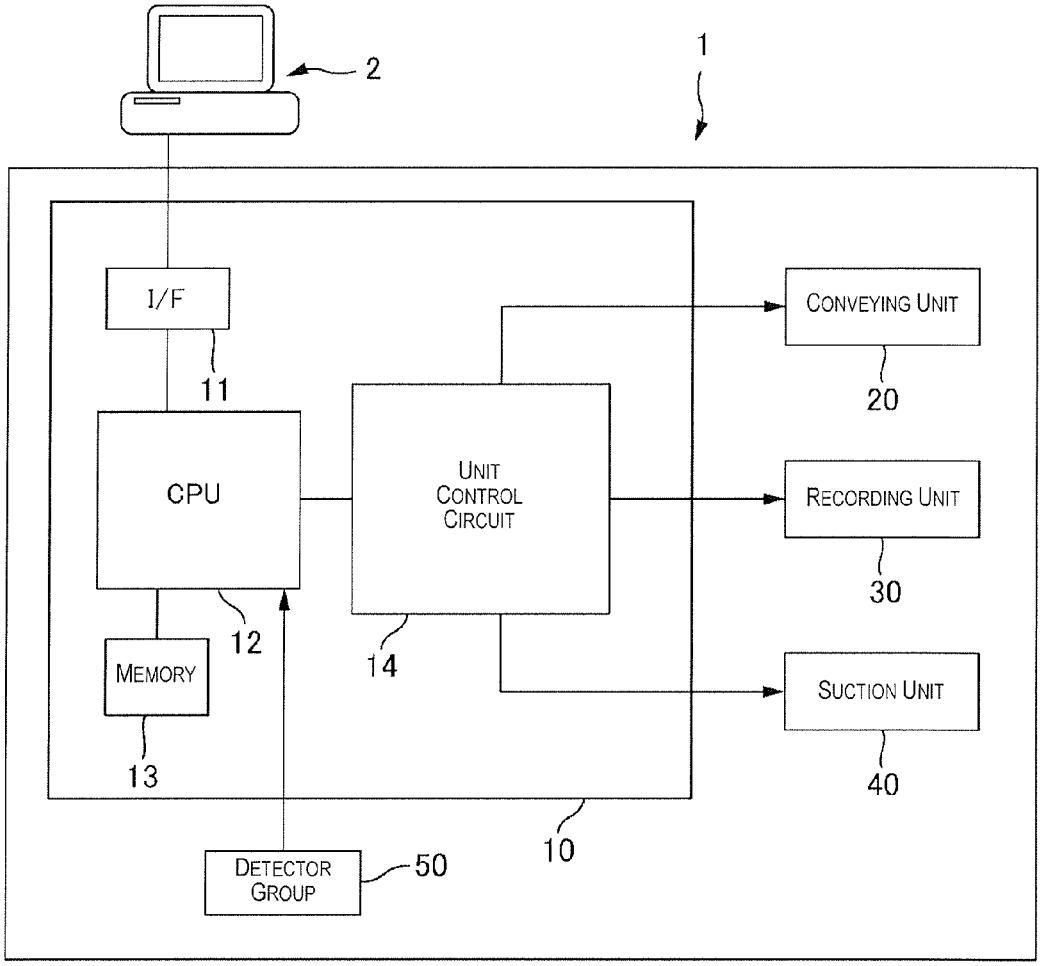
FIG. 1 is a block diagram of the overall configuration of the printer.

At least the following matter will be made apparent by this specification and the descriptions provided in reference to the accompanying drawings.

An image recording device according to the embodiment includes a recording part, a conveying part, a medium support part, a suction part and a control part. The recording part is configured and arranged to record an image on a medium. The conveying part is configured and arranged to convey the medium. The medium support part is configured and arranged to support the medium on a support surface provided with openings of suction holes. The suction part is configured and arranged to suction the medium supported on the medium support part via the suction holes, the suction part having a negative pressure chamber communicating with the suction holes and at least two air-blowing parts whereby air in an interior of the negative pressure chamber is discharged and a negative pressure is produced inside the negative pressure chamber, the air-blowing parts being attached at different positions on an outer surface of the negative pressure chamber. The control part is configured to switch between a first mode in which a suction force of the suction part on the medium is set to a first suction force and a second mode in which the suction force is set to a second suction force that is lower than the first suction force. The control part is configured to stop one of the air-blowing parts in the second mode.

As a result of this type of image recording device, it is possible to reduce the time required to switch from the first mode to the second mode (time required for reducing the suction force).

With this image recording device, a volume of air passing through an opening part of the negative pressure chamber communicating with a suction opening of a first air-blowing part among the air-blowing parts is preferably greater than a volume of air passing through an opening part of the negative pressure chamber communicating with a suction opening of the other of the air-blowing parts.

As a result of this image recording device, it is possible to increase the range of negative pressures that can be generated in the negative pressure chamber. As a result, the suction force on the medium can be further increased or reduced.

With this image recording device, the control part is preferably configured to stop the first air-blowing part during the second mode.

As a result of this image recording device, the negative pressure in the negative pressure chamber can be additionally decreased during the second mode. As a result, the suction force on the medium can be additionally decreased.

With this image recording device, the one of the air-blowing parts preferably includes at least two air-blowing mechanisms aligned in series.

As a result of this image recording device, the volume of air passing through the opening part of the negative pressure chamber that communicates with the suction opening of the one air-blowing part can be increased.

With this image recording device, the control part is preferably configured to switch from the first mode to the second mode during an action of recording the image on the medium as performed by the recording part.

As a result of the image recording device, the overall recording operating period can be reduced.

With this image recording device, the air-blowing parts are preferably attached directly or indirectly to the medium support part.

As a result of this image recording device, because the one air-blowing part is stopped during the second mode, for example, vibrations transmitted to the base on which the medium support part is carried can be suppressed, and the accuracy of discharge problem inspection can be increased.

In addition, an image recording method according to the embodiment is a method for recording an image on a medium by an image recording device including: a recording part configured and arranged to record an image on a medium; a conveying part configured and arranged to convey the medium; a medium support part configured and arranged to support the medium on a support surface provided with openings of suction holes; a suction part configured and arranged to suction the medium supported on the medium support part via the suction holes, the suction part having a negative pressure chamber communicating with the suction holes and at least two air-blowing parts whereby air in an interior of the negative pressure chamber is discharged and a negative pressure is produced inside the negative pressure chamber, the air-blowing parts being attached at different positions on an outer surface of the negative pressure chamber; and a control part configured to switch between a first mode in which a suction force of the suction part on the medium is set to a first suction force and a second mode in which the suction force is set to a second suction force that is lower than the first suction force, the control part being configured to stop one of the air-blowing parts in the second mode. The image recording method includes recording the image on the medium by using the image recording device.

As a result of this image recording method, the switching time from the first mode to the second mode (time required for suction pressure reduction) can be shortened.

Printer

An embodiment is described below in which an ink jet printer ("printer" below) is used as the image recording device.

Figure 2:
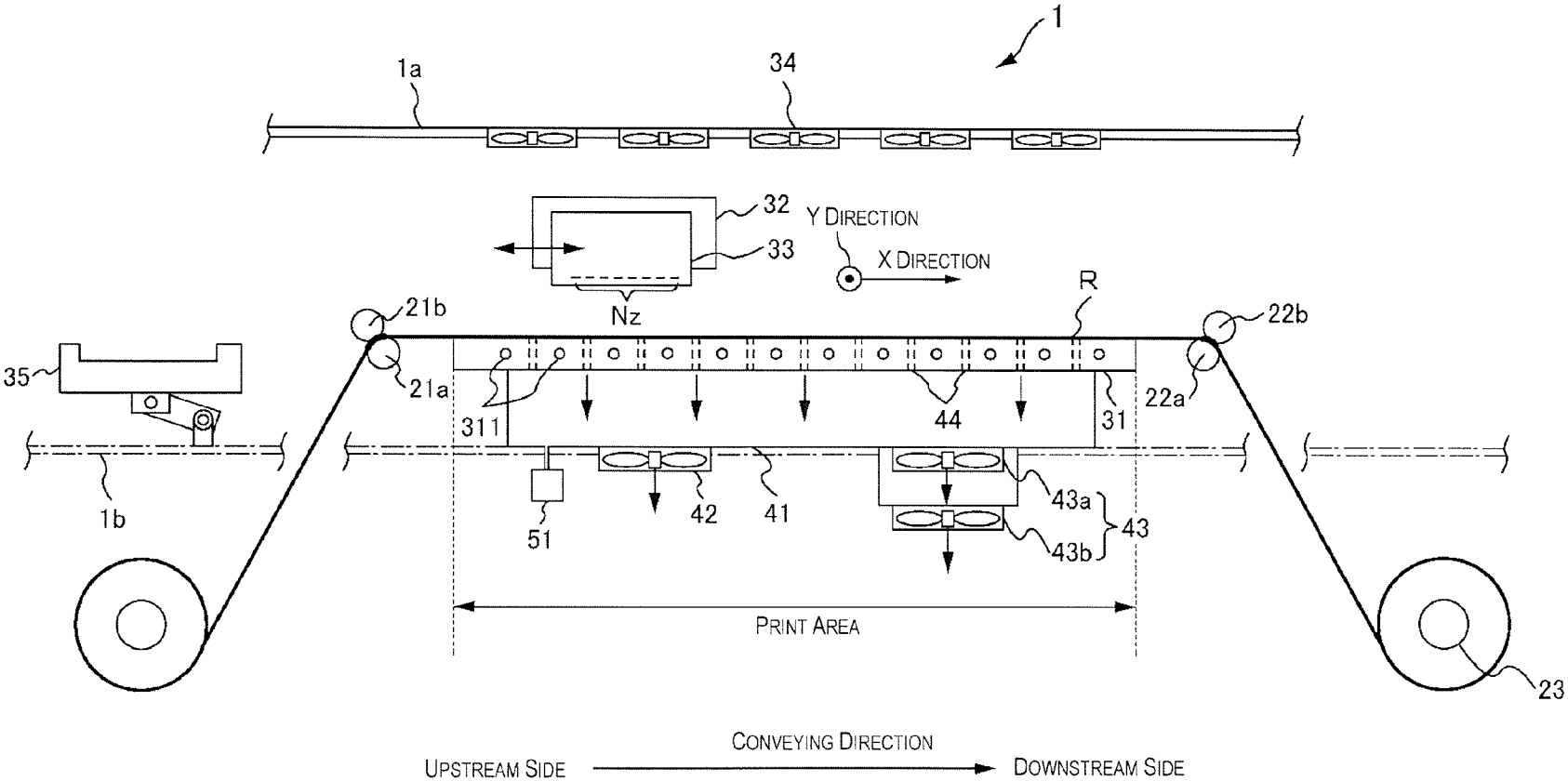
FIG. 2 is a schematic sectional view of the printer.

FIG. 1 is a block diagram of the overall configuration of the printer 1. FIG. 2 is a schematic sectional view of the printer 1. According to the printer 1 of the present embodiment, an image is recorded on a paper roll R (continuous paper) which is used as the medium. The medium is not restricted to paper. For example, film or fabric may also be used. The printer 1 of this embodiment is connected so as to allow communication with a computer 2, and the computer 2 generates printing data for printing of the image by the printer 1. The functions of the computer 2 may also be contained inside the printer 1.

A controller 10 is the control unit whereby the printer 1 is controlled. An interface part 11 is for carrying out data transmission and reception between the computer 2 and the printer 1. A CPU 12 is the computation processing device that controls the entire printer 1. A memory 13 is used for providing space for carrying out operations or space for storing the programs of the CPU 12. The CPU 12 controls each unit in accordance with a unit control circuit 14. A detector group 50 that detects the state inside the printer 1 is monitored, and the controller 10 controls each unit based on the results of detection.

The conveying unit 20 (corresponding to the conveying part) conveys the roll paper R along a preset conveying pathway from the upstream side to the downstream side in the direction of conveyance, and part of the roll paper R is conveyed to the print area. The conveying unit 20 has supply rolls 21*a*, 21*b*, discharge rolls 22*a*, 22*b*, a winding roll 23, and the like. The supply rolls 21*a*, 21*b* and the discharge rolls 22*a*, 22*b* are composed of rolls that form respective pairs, where one of the rolls is the drive roll that is rotated by a motor (not shown), and the other roll is a slave roll that rotates in association with the drive roll. When printing of the image on the roll paper R that is situated in the print area has been completed, the section of the roll paper R having the printed image is discharged from the print area by the supply rolls 21*a*, 21*b* and the discharge rolls 22*a*, 22*b* and is wound in the form of a roll by the winding roll 23. A section of the roll paper R on which an image has not yet been printed is then fed to the print area.

The recording unit 30 (corresponding to the recording part) prints (records) an image on the roll paper R that is situated in the print area. The roll paper R that is situated in the print area is supported by the top surface of the platen 31 (corresponding to the medium support part) from the back surface side that is on side opposite from the printing surface. The recording unit 30 has a carriage 32, a head 33, and the like. The carriage 32 is guided on a guide shaft (not shown), and the head 33 is made to move in the X direction (conveying direction of the roll paper R) and the Y direction (transverse direction of the roll paper R). The head 33 is used for discharging ink onto the roll paper R, and a plurality of nozzles Nz which are the ink discharge parts are provided on the bottom surface of the head 33. The format whereby the ink is discharged from the nozzles may be a piezo format in which the ink is discharged as a result of expansion and contraction of a pressure chamber by application of voltage to a drive element (piezo element), or a thermal format in which ink is discharged by gas bubbles that are generated in the nozzles using a heating element.

A plurality of heaters 311 (e.g., nichrome wires) are laid out inside the platen 31. By passing current through the heaters 311, the temperature of the platen 31 increases, and the temperature of the roll paper R on the platen 31 (specifically, the roll paper R that is situated in the print area) increases. As a result, drying of the ink that has landed on the roll paper R that is on the platen 31 is accelerated, and bleeding of the ink in the printed image can be suppressed. The heaters 311 are laid out across the entire region of the platen 31 so that heat is uniformly conducted to the roll paper R on the platen 31.

In addition, a plurality of ceiling fans 34 are provided opposite the platen 31 in the ceiling part 1*a* of the frame of the printer 1. By conducting air from the ceiling fans 34 towards the roll paper R on the platen 31, drying of the ink that has landed on the roll paper R on the platen 31 can be accelerated.

In addition, the carriage 32 and the head 33 can retract to a home position that is further upstream than the print area in relation to the conveying direction. A capping mechanism 35 or the like is provided in the home position. During printing stoppage, the nozzle surfaces of the head 33 are sealed off by this capping mechanism 35, allowing evaporation of ink from the nozzles to be suppressed.

In addition, a base 1*b* having the form of a flat plate is provided in the frame of the printer 1, and the interior of the fame is partitioned into two spaces. Printing of the image on the roll paper R is carried out in the space that is above the base 1*b*. Thus, the head 33 and the carriage 32 are situated in the space that is above the base 1*b*, and the platen 31, a negative pressure chamber 41, and the capping mechanism 35 are carried on the base 1*b*.

A suction unit 40 (corresponding to the suction part) is used for suctioning and chucking the roll paper R on the platen 31 to the support surface of the platen 31, and the unit has the negative pressure chamber 41, a first fan mechanism 42, a second fan mechanism 43, suction holes 44, and the like. The negative pressure chamber 41 is connected to the bottom surface of the platen 31, and the first fan mechanism 42 and the second fan mechanism 43 are attached to the bottom surface of the negative pressure chamber 41 so that they are aligned in the conveying direction. The second fan mechanism 43 is composed of two fans 43*a*, 43*b*, where the other fan 43*b* is attached below (towards the discharge opening of) the one fan 43*a*. In addition, suction holes 44 which are holes that pass vertically through the platen 31 are formed, and one opening part of the suction holes 44 is provided in the support surface of the platen 31, and the other opening part of the suction holes 44 is provided in the bottom surface of the platen 31 (connecting surface between the platen 31 and the negative pressure chamber 41). Specifically, the negative pressure chamber 41 communicates externally (upper part of the platen 31) via the suction holes 44. In addition, the platen 31 supports the roll paper R with the support surface in which the opening parts of the suction holes 44 are provided.

The first fan mechanism 42 and the second fan mechanism 43 discharge air inside the negative pressure chamber 41 externally (specifically, they suction air inside the negative pressure chamber 41), thereby placing the interior of the negative pressure chamber 41 in a negative pressure state. The external air above the support surface of the platen 31 is suctioned to the interior of the negative pressure chamber 41 via the suction holes 44, and the roll paper R on the platen 31 is suctioned and chucked onto the support surface of the platen 31. Specifically, the suction unit 40 uses the fan mechanisms 42 and 43 to suction the roll paper R that is supported on the platen 31 via the suction holes 44.

During printing, the roll paper R on the platen 31 is suctioned and chucked to the support surface of the platen 31, and the roll paper R is held in a prescribed position on the support surface of the platen 31, allowing the ink droplets to land in the correct positions. Moreover, the roll paper R can be held in a flat state even though the roll paper R swells due to the water content in the ink droplets.

With the printer 1 having this type of mechanism, the controller 10 produces a two-dimensional image by printing (corresponding to the recording operation) on the roll paper R that is situated in the print area as the head moves in the X direction and Y direction along with the carriage 32. Subsequently, the controller 10 causes the conveying unit 20 to discharge the section of the roll paper R with the printed image from the print area and to feed a section of the roll paper R not having a printed image into the print area (corresponding to the conveying operation). In other words, the controller 10 (corresponding to the control part) prints multiple images in the longitudinal direction of the roll paper R by repeatedly performing the image printing action and the roll paper R conveying operation.

Maintenance Action

Moisture in the ink tends to evaporate from the nozzle meniscus (free surface of the ink that is externally exposed), and the viscosity of the ink thus increases due to evaporation. When the ink becomes viscous, the prescribed amount of ink is not discharged at the time when the ink is to be discharged from the nozzles, and discharge problems arise. In addition, air becomes admixed from the nozzle meniscuses, and contaminants affix to the nozzles, which also causes the occurrence of discharge problems. When discharge problems arise in the nozzles, the quality of the printed image deteriorates.

Thus, with the printer 1 of this embodiment, periodic maintenance actions are performed. The term "maintenance actions" refers to discharge problem inspection involving detection of the presence of a nozzle (a failed nozzle) that is experiencing discharge problem or "cleaning actions" involving cleaning so that the ink is properly discharged from a failed nozzle. With maintenance actions, a cleaning action may be carried out only if a failed nozzle is detected after performing discharge problem inspection, or a cleaning action and a discharge problem inspection may be repeatedly carried out until a failed nozzle is not detected.

Discharge Problem Inspection

The discharge problem inspection unit (not shown) in this embodiment has a high-potential inspection electrode, an ink recovery part, and the like, where the detection electrode is carried in the ink recovery part. The discharge problem inspection unit, as with the capping mechanism 35 of FIG. 2, is carried on the base 1*b* of the printer 1 in the home position. The nozzle surface of the head 33 (nozzle plate; sheet-form member having conductivity) is connected to ground and is thus at lower potential (ground potential) than the detection electrode. In addition, the ink solvent serves as a conductive liquid (e.g., water). Thus, the ink that is discharged from the nozzle is at ground potential.

During discharge problem detection, the head 33 is first retracted to the home position. Next, the head 33 (nozzle plate) and the detection electrode are brought into opposition in a condition in which a prescribed gap has been provided, and ink is discharged (continuously) from the nozzle that is to be inspected. Next, it is determined whether or not ink droplets have been properly discharged from the inspected nozzle based on electrical changes (changes in potential) arising on the side of the detection electrode caused by ink discharge. For example, electrical changes arising at the detection electrode are acquired as a voltage signal, and it is determined that discharge of ink from the nozzle has properly occurred if the maximum amplitude of the voltage signal is greater than a threshold value. If the maximum amplitude of the voltage signal is at or below the threshold value, then it is determined that ink has not been properly discharged from the nozzle. The ink that has been discharged in from the nozzle in the direction of the detection electrode is recovered by the ink recovery part, so that contamination of the interior of the printer 1 can be prevented. The discharge problem inspection method is not restricted to this method, and other methods may be used.

Cleaning Action

In this embodiment, the cleaning action is carried out by flushing, pump suctioning, wiping, or another procedure. At the time of the cleaning action, the head 33 is retracted to the home position, as during discharge problem detection.

"Flushing" is an operation in which ink is forcibly discharged from the nozzle by the head 33 with the ink recovery part (not shown) on the opposite side, so that the thickened ink and the contaminants adhering to the nozzle surface are discharged along with the ink.

"Pump suctioning" is an operation in which the nozzle surface of the head 33 and the ink recovery part are brought into close contact, and pump suctioning is carried out via a tube that is connected to the bottom surface of the ink recovery part (not shown). The thickened ink inside the head 33 is thereby suctioned along with contaminants.

"Wiping" refers to an operation in which contaminants and the like are removed by wiping the nozzle surface with a rubber wiper or the like.

High-Suction Mode and Low-Suction Mode

Figure 3A:
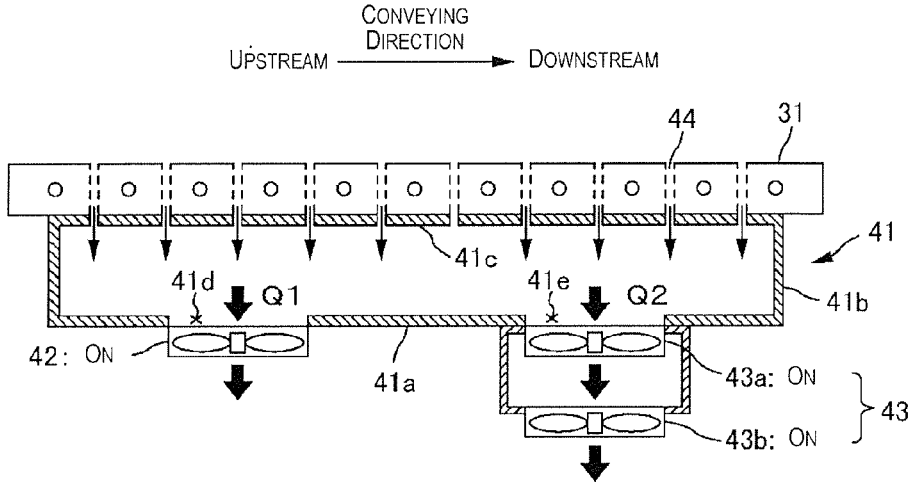
FIG. 3A is a diagram for describing the high-suction mode.
Figure 3B:
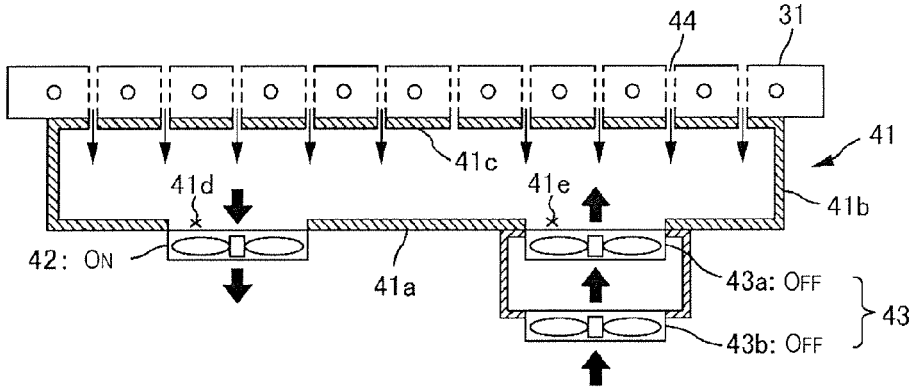
FIG. 3B is a diagram for describing the low-suction mode.

FIG. 3A is a drawing for describing the high-suction mode and FIG. 3B is a diagram for describing the low-suction mode. As described above, the printer 1 of this embodiment has a suction unit 40 that suctions the roll paper R that is supported on the platen 31 via the suction holes 44, where the suction unit 40 has a negative pressure chamber 41 that communicates with the suction holes 44, and a first fan mechanism 42 and a second fan mechanism 43 that discharge air inside the negative pressure chamber 41 and create a negative pressure in the negative pressure chamber 41. Numerous holes are provided in the top surface 41*c* of the negative pressure chamber 41, and the holes that are provided in the top surface 41*c* of the negative pressure chamber 41 communicate with the suction holes 44 that are provided in the platen 31. The description "first fan mechanism 42 and second fan mechanism 43" used herein corresponds to "two air-blowing parts," and an "(axial flow) fan" is provided as an example of the "air-blowing device".

The roll paper R is held at a prescribed position on the platen 31 during the image printing action on the roll paper R, and the roll paper R is held in a flat state even though the roll paper R swells due to the water content in the ink. It is thus desirable for the suction force with which the roll paper R is chucked to the support surface of the platen 31 to be a strong as possible. During the printing action, the roll paper R is tightly suctioned and chucked onto the support surface of the platen 31 and is held in a flat state. As a result, the heat from the platen 31 (heater 311) is transferred to the roll paper R on the platen 31, allowing acceleration of ink drying and prevention of image bleeding. In addition, the ink droplets can be made to land in the correct positions on the roll paper R, and contact of the roll paper R and the head 33 can be prevented. Specifically, deterioration in image quality of the printed image can be suppressed by maintaining the roll paper R on the platen 31 in a flat state at the prescribed position.

On the other hand, in order that there is not a significant resistance to conveyance during the conveying operation for the roll paper R, the suction force with which the roll paper R is chucked to the support surface of the platen 31 is preferably decreased as much as possible without the roll paper R being allowed to slacken.

In other words, during the conveying operation, the suction force of the suction unit 40 on the roll paper R on the platen 31 is preferably lower than during the printing action. In this manner, the appropriate suction force placed on the roll paper R on the platen 31 will be different depending on the processing operation.

Thus, with the printer 1 of this embodiment, the controller 10 can perform switching between a "high-suction mode" (corresponding to the first mode) in which the suction force of the suction unit 40 on the roll paper R is placed at a high suction force (corresponding to the first suction force) and a "low-suction mode" (corresponding to the second mode) in which the suction force of the suction unit 40 on the roll paper R is placed at a lower suction force (corresponding to the second suction force) than the suction force of the high-suction mode.

Next, the controller 10 is set to the high-suction mode during the printing action and is set to the low-suction mode during conveyance of the roll paper R. In so doing, the roll paper R on the platen 31 can be held in a flat state at a prescribed position during the printing action, and degradation in the quality of the printed image can be prevented. On the other hand, during the conveying action for the roll paper R, the suction force with which the roll paper R is chucked to the support surface of the platen 31 can be reduced, and conveyance can be smoothly carried out. In other words, by setting the mode to the low-suction mode during conveyance of the roll paper R, the driving force of the conveying unit 20 (e.g., the pulling force of the discharge rolls 22*a* and 22*b*) can be reduced.

The negative pressure in the negative pressure chamber 41 may be changed in order to vary the suction force on the roll paper R on the platen 31. By increasing the negative pressure in the negative pressure chamber 41 (reducing the pressure), the suction force on the roll paper R on the platen 31 can be increased, and, by decreasing the negative pressure in the negative pressure chamber 41 (increasing the pressure) the suction force on the roll paper R on the platen 31 can be reduced. Specifically, the printer 1 in this embodiment can be described as a printer that is switchable between a mode in which the negative pressure in the negative pressure chamber 41 is at high negative pressure and a mode in which the negative pressure in the negative pressure chamber 41 is at low negative pressure.

However, after completion of the printing action, the mode is switched from the high-suction mode to the low-suction mode, and if a long time is required for the high-suction mode to switch the low-suction mode when the conveying operation is to be carried out on the roll paper R, then the time for the entire printing action will increase. Moreover, if the mode is changed from the high-suction mode to the low-suction mode during the printing action in order to reduce the overall printing action time, then the period during which the high-suction mode is not present during the printing action will increase if a long time is required to switch from the high-suction mode to the low-suction mode.

Therefore, the aim in this embodiment is to shorten, as much as possible, the time for switching from the high-suction mode to the low-suction mode (specifically, the time required for reducing the suction force on the roll paper R).

According to the printer 1 of this embodiment, the first fan mechanism 42 and the second fan mechanism 43 are attached at different positions on the bottom surface 41*a* of the negative pressure chamber 41 (the shafts of the two fan mechanisms 42 and 43 are not coaxial; the two fan mechanisms 42 and 43 are attached in parallel). The controller 10 stops one fan mechanism of the two fan mechanisms 42, 43 during the low-suction mode.

Specifically, in the high-suction mode, as shown in FIG. 3A, the first fan mechanism 42 and the second fan mechanism 43 are both in an ON state. In this case, the air in the negative pressure chamber 41 is drawn out externally by the two fan mechanisms 42, 43. During the low-suction mode, on the other hand, as shown in FIG. 3B, the first fan mechanism 42 is in an ON state, and the second fan mechanism 43 is in an OFF state (stopped). In this case, the air in the negative pressure chamber 41 is drawn out externally by the first fan mechanism 42, and the interior of the negative pressure chamber 41 is open to the atmosphere as a result of the second fan mechanism 43. For this reason, external air from the second fan mechanism 43 is sucked into the negative pressure chamber 41. Specifically, external air passes through the opening part 41*e* of the negative pressure chamber 41 that communicates with the suction opening of the second fan mechanism 43 and is suctioned into the negative pressure chamber 41. As a result, the negative pressure in the negative pressure chamber 41 is immediately reduced (pressure is increased), and switching from the high-suction mode to the low-suction mode can occur rapidly.

In other words, in accordance with the printer 1 of this embodiment (or in accordance with the printing method that utilizes the printer 1 of this embodiment), the second fan mechanism 43 is stopped in the low-suction mode, and the second fan mechanism 43 (specifically, the opening part 41*e* of the negative pressure chamber 41 that communicates with the suction opening of the second fan mechanism 43) is used as an "air hole." It is thus possible to shorten the switching time from the high-suction mode to the low-suction mode.

As a result, for example, the overall printing action time can be shortened when switching from the high-suction mode to the low-suction mode after the printing action. On the other hand, time in the high-suction mode during printing can be lengthened when switching form the high-suction mode to the low-suction mode during the printing action.

Moreover, the second fan mechanism 43 that is used in order to generate a high negative pressure in the high-suction mode is used as an air hole in the low-suction mode, and it is not necessary to provide a separate air hole (e.g., an automatic opening/closing window), thereby allowing the configuration of the device to be simplified.

Moreover, because the one fan mechanism 43 of the two fan mechanisms 42 and 43 is stopped during the low-suction mode, noise and vibration can be reduced in comparison to when in high-suction mode, and it is possible to suppress power consumption.

With the printer 1 of this embodiment, one fan mechanism 43 of the fan mechanisms 42 and 43 is stopped during the low-suction mode and is used as an air hole, and the two fan mechanisms 42, 43 are attached in parallel in the negative pressure chamber 41. When the two fans are attached in parallel, the amount of air increases, but there is almost no change in static pressure.

Thus, the air volume ($m^3$/h) that passes through the opening part of the negative pressure chamber 41 that communicates with the suction opening of one fan mechanism of the two fan mechanisms that are attached in parallel is greater than the air volume ($m^3$/h) passing through the opening part of the negative pressure chamber 41 that communicates with the suction opening of the other fan mechanism. In other words, the negative pressure in the negative pressure chamber 41 generated by one fan mechanism of the two fan mechanisms that are attached in parallel is made to be higher than the negative pressure that is generated in the negative pressure chamber 41 by the other fan mechanism.

To this end, with the printer 1 of this embodiment, the second fan mechanism 43 in which two fan mechanisms are attached in series (attached so that the axes of the two fans are situated on the same axis) an the first fan mechanism 42 that is constituted by one fan are attached in parallel. By operating the two fans that are attached in series, the static pressure can be increased more than when one fan having identical characteristics is operated. Specifically, a high negative pressure can be generated in the negative pressure chamber 41 when the air in the negative pressure chamber 41 is discharged by the two fans that are attached in series (second fan mechanism 43) more so than when the air in the negative pressure chamber 41 is discharged by a single fan (first fan mechanism 42).

In other words, by providing the first fan mechanism 42 in parallel with the second fan mechanism 43 that has higher static pressure characteristics than the first fan mechanism 42 in the printer of this embodiment, the air volume Q2 passing through the opening part 41*e* of the negative pressure chamber 41 that communicates with the suction opening of the second fan mechanism 43 (corresponding to one air-blowing part) is greater than the air volume Q1 passing through the opening part 41*d* of the negative pressure chamber 41 that communicates with the suction opening of the first fan mechanism 42 (corresponding to the other air-blowing part).

In so doing, in the high-suction mode, the negative pressure in the negative pressure chamber 41 can be additionally increased as a result of the second fan mechanism 43 producing a large air volume Q2 that passes through the opening part 41*e* of the negative pressure chamber 41 (specifically, the second fan mechanism 43 having high maximum static pressure characteristics). In the low-suction mode, the negative pressure in the negative pressure chamber 41 can be additionally decreased as a result of the first fan mechanism 42 whereby the air volume Q1 passing through the opening part 41*d* of the negative pressure chamber 41 is small (specifically, the first fan mechanism 42 having low maximum static pressure characteristics). In other words, the range of negative pressures generated in the negative pressure chamber 41 can be broadened, and the interior of the negative pressure chamber 41 can be placed at the desired high negative pressure in high-suction mode (e.g., during printing actions), whereas the interior of the negative pressure chamber 41 can be placed at the desired low negative pressure in the low-suction mode (e.g., during the conveying operation).

Moreover, by attaching a fan having comparatively low static pressure characteristics and a fan having comparatively high static pressure characteristics in parallel, the volume of air passing through the opening part of the negative pressure chamber 41 that communicates with the suction openings of each of the fans can be made different. However, fans with high static pressure characteristics of the type that can place the interior of the negative pressure chamber 41 at the desired high negative pressure in the high-suction mode are large fans, and costs also increase.

In addition, when two fans having the same static pressure characteristics are attached in parallel, by changing the rotation rates of the fans, it is possible to produce different air volumes that pass through the opening part of the negative pressure chamber 41 that communicates with the suction opening of each fan. However, simply adjusting the rotation rate of the fans limits the production of different air volumes passing through the opening part of the negative pressure chamber 41. In so doing, the negative pressure differential in the negative pressure chamber 41 in the high-suction mode and the low-suction mode decreases, making it difficult to set the interior of the negative pressure chamber 41 at the desired negative pressure.

Thus, as in this embodiment, one of the fan mechanisms (second fan mechanism 43) of the two fan mechanisms 42, 43 may have a configuration in which the two fans are attached in series. In so doing, reductions in equipment size and costs are achieved, and different volumes of air that passes through the opening part of the negative pressure chamber 41 that communicates with the suction opening of the parallel fans can be produced. As a result, the range of negative pressures that are produced in the negative pressure chamber 41 is broadened. In addition, two or more fans may be attached in series in the second fan mechanism 43.

Moreover, by stopping the first fan mechanism 42 having low maximum static pressure characteristics during the low-suction mode, the first fan mechanism 42 functions as an air hole, and the negative pressure in the negative pressure chamber 41 during the low-suction mode can be reduced in comparison to the high-suction mode in which the two fan mechanisms 42, 43 are in an ON state. However, as in this embodiment, because the second fan mechanism 43 (specifically, the second fan mechanism 43 having high maximum static pressure characteristics) producing a high air volume Q2 passing through the opening part 41*e* of the negative pressure chamber 41 is stopped during the low-suction mode, the negative pressure in the negative pressure chamber 41 can be additionally decreased in the low-suction mode. As a result, the suction force with which the roll paper R is chucked on the support surface of the platen 31 can be weakened, and, for example, conveying can occur smoothly, or the drive force of the conveying unit 20 can be reduced.

The pressure (negative pressure) in the negative pressure chamber 41 in high-suction mode and low-suction mode may be set in accordance with the drive force of the conveying unit 20, the type of roll paper R, and the like. For example, the pressure in the negative pressure chamber 41 in high-suction mode may be set to a pressure that is 805 Pa lower than air pressure, and the pressure in the negative pressure chamber 41 in low-suction mode can be set to a pressure that is 140 Pa lower than atmospheric pressure. In addition, the negative pressure in the negative pressure chamber 41 can be adjusted to the desired negative pressure by adjusting the rotation rates of the fan mechanisms 42, 43. Moreover, by providing the negative pressure chamber 41 with a pressure sensor 51 that detects the air pressure in the negative pressure chamber 41, the controller 10 can confirm whether the pressure in the negative pressure chamber 41 is at the desired pressure (negative pressure).

Figure 4A:
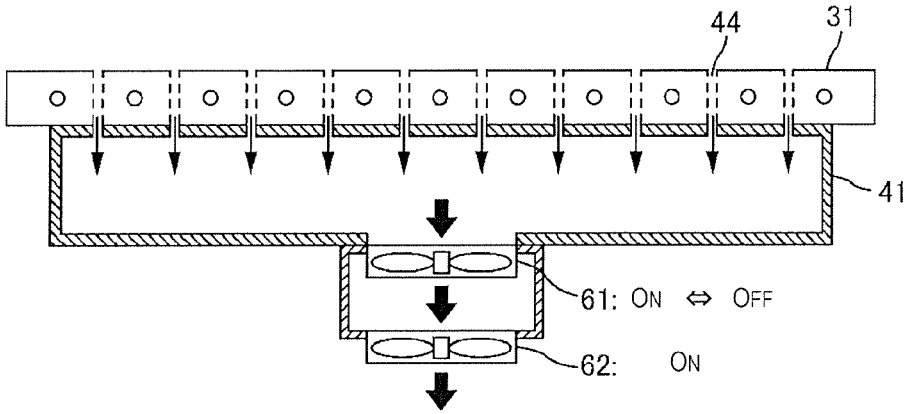
FIGS. 4A and 4B are diagrams for describing the suction units of comparative examples.
Figure 4B:
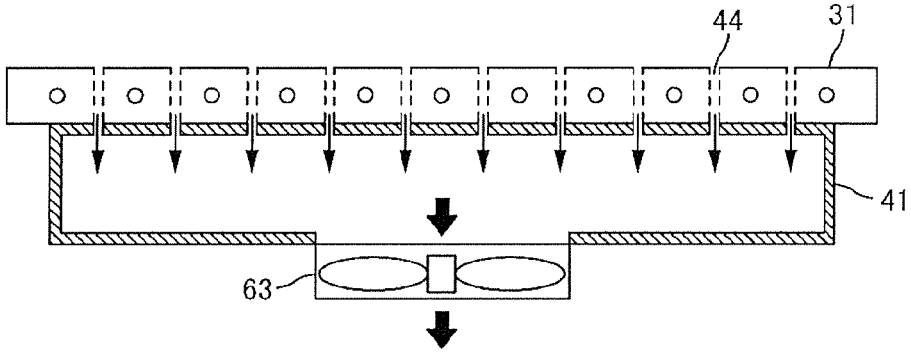

FIGS. 4A and 4B are diagrams that describe the suction unit of a comparative example.

As shown in FIG. 4A, two fans 61, 62 are attached in series, and the two fans 61, 62 are in an ON state during high-suction mode, whereas one of the fans 61 of the two fans 61, 62 is in an OFF state during low-suction mode. As a result, the negative pressure in the negative pressure chamber 41 can be set to the desired negative pressure in each suction mode.

Moreover, as shown in FIG. 4B, by attaching one fan 63 having maximum static pressure characteristics and controlling its rotation rate, the negative pressure in the negative pressure chamber 41 can be set to the desired negative pressure in each suction mode.

However, as in the comparative example (FIGS. 4A, 4B), when fans are only attached at the same position (one location) on the outer surface of the negative pressure chamber 41, it is not possible to use one of the fan mechanisms 43 of the two fan mechanisms 42, 43 as an air hole as in this embodiment (FIG. 3B) during low-suction mode. For this reason, more time will be required for switching from the high suction mode to the low suction mode with the suction unit of the comparative example in comparison to the suction unit 40 of this embodiment.

Thus, in this embodiment, two fan mechanisms 42, 43 are attached at different positions on the outer surface of the negative pressure chamber 41. In other words, on the outer surfaces of the negative pressure chamber 41, the two fan mechanisms 42, 43 are attached at different positions on surfaces (the lower surface 41*a* and the side surface 41*b*) that are not the top surface 41*c* where the holes that communicate with the suction holes 44 are provided. In this embodiment, an example was provided in which the two fan mechanisms 42, 43 were attached to the bottom surface 41*a* of the negative pressure chamber 41, but the invention is not limited to this example. The two fan mechanisms 42, 43 may also be attached to the side surface 41*b* of the negative pressure chamber 41.

In addition, at least two fan mechanisms may be attached to the negative pressure chamber 41, and when three or more fan mechanisms are attached, (at least) one of the fan mechanisms can be stopped during the low-suction mode, and the stopped fan mechanism can be used as a suction hole. As a result, the switching time from the high suction mode to the low suction mode can be shortened. In addition, two fan mechanisms in which two fans are attached in series (specifically, the second fan mechanism 43) may be attached in parallel. In this case, in high-suction mode, the two fan mechanisms are placed in an ON state (specifically, the four fans are in an ON state), and, in the low suction mode, one of the fan mechanisms is stopped, and the other fan mechanism may be in a state in which one of the two grouped fans is in an ON state (specifically, three of the fans may be in an OFF state).

Moreover, during the maintenance actions described above (discharge problem inspection/cleaning actions) it is not necessary for the suction force with which the roll paper R is chucked to the support surface of the platen 31 to be strong, as during the printing action. Thus, during maintenance actions, the device may be set to the low-suction mode. In so doing, noise and vibrations can be reduced, and power costs can also be reduced.

In particular, with the printer 1 of this embodiment, as shown in FIG. 2, two fan mechanisms 42, 43 are attached indirectly to the platen 31 via the negative pressure chamber 41. For this reason, vibrations due to the fan mechanisms 42, 43 are readily transferred to the discharge problem inspection unit (not shown) that is also on the base 1*b* in the home position via the base 1*b* of the printer 1 that carries the negative pressure chamber 41 and the platen 31. In addition, when discharge problem is to be determined based on electrical changes arising in the detection electrode, as in discharge problem inspection described above, vibrations from the fan mechanisms 42, 43 are a source of noise. Thus, during maintenance actions, vibrations can be reduced by setting the device to low-suction mode with one of the fan mechanisms 43 of the two fan mechanisms 42, 43 stopped. As a result, noise can be lowered during discharge problem detection, and the accuracy of discharge problem detection can be increased.

A configuration may also be used in which the two fan mechanisms 42, 43 are attached directly to the platen 31. In addition, in order to reduce vibrations from the fan mechanisms 42, 43, a shock-absorbing material may be provided between the negative pressure chamber 41 and the fan mechanisms 42, 43. Moreover, with the printer 1 of this embodiment, the platen 31 and the negative pressure chamber 41 are separate members, but the invention is not restricted to this embodiment; the top surface 41*c* of the negative pressure chamber 41 may be used as the platen 31.

Printing Action

Figure 5A:
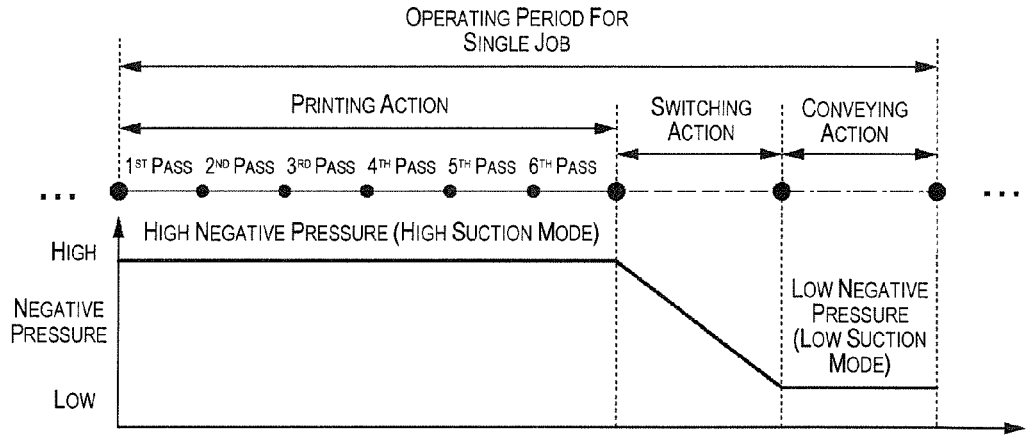
FIG. 5A is a diagram describing the operating period for a single job in the comparative example.
Figure 5B:
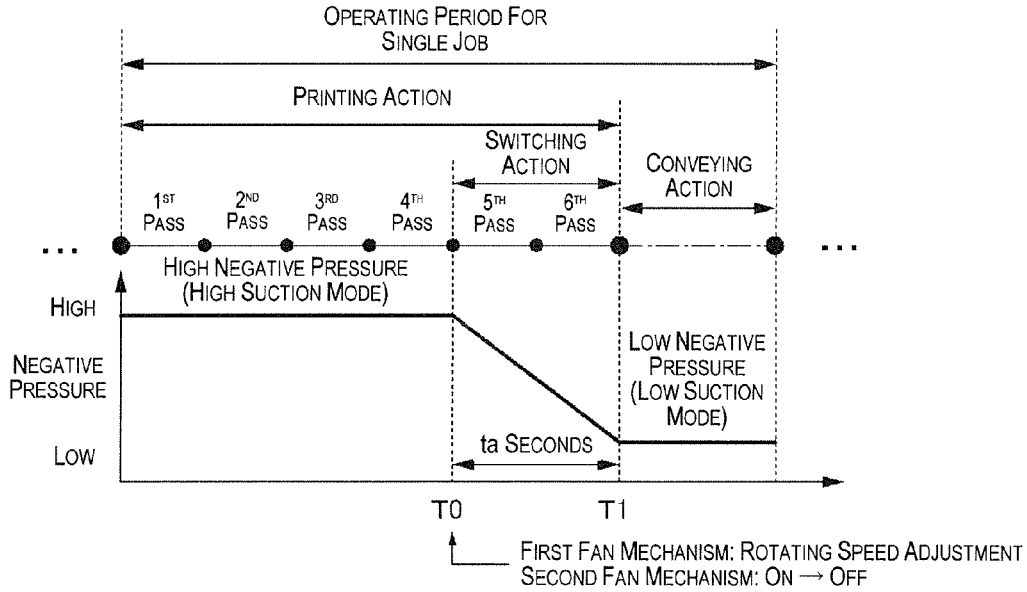
FIG. 5B is a diagram describing the operating period for a single job in the embodiment.

FIG. 5A is a diagram for illustrating the operating period for a single job in the comparative example. FIG. 5B is a diagram for describing the operating period for a single job in the embodiment. The operations extending from the printing action in which an image is printed on the roll paper R that is situated in the print area to the conveying operation in which a new section of the roll paper R is conveyed to the print area is referred to as a single job. In addition, the operation in which ink is discharged onto the roll paper R while the head 33 moves in the X direction (conveying direction of the roll paper) with respect to the roll paper R that is positioned in the print area is referred to as one pass. Because an operation is also carried out in which the head 33 is moved in the Y direction (transverse direction of the roll paper R) during the pass, a two-dimensional image is printed on the roll paper R. An example is described below in which printing of an image is completed in six passes over the roll paper R that is situated in the print area. The number of passes for completion of image printing will change depending on the size of the image and the printing resolution.

In the comparative example (FIG. 5A), the controller 10 of the printer 1 maintains the high-suction mode during the entire printing action (during all six passes), and a switching action involving switching from the high-suction mode to the low-suction mode is carried out after the printing action. Subsequently, the controller 10 carries out a conveying operation after completion of switching form the high-suction mode to the low-suction mode. Specifically, the operating period for one job in the comparative example is the total of the time required for the printing action, the time required for the switching action, and the time required for the conveying operation. The operating period for one job is comparatively long.

As described above, with the printer 1 of this embodiment, one fan mechanism 43 of the two fan mechanisms 42, 43 that generate negative pressure in the negative pressure chamber 41 is stopped during the low-suction mode, and the stopped fan mechanism 43 is used as an air hole. Thus, the switching time from the high-suction mode to the low-suction mode is shortened. However, although it is true that the time for the switching action has been shortened, as shown in the comparative example (FIG. 5A), it is inefficient for time to be taken just for the switching action as an operation that is separate from printing.

Thus, in this embodiment, the objective is to shorten the overall printing action time as much as possible.

Thus, with the printer 1 of this embodiment (FIG. 5B), the controller 10 stops one of the fan mechanisms 43 of the two fan mechanisms 42, 43 during the operation prior to the conveying action, specifically, during the printing action. As a result, the mode is switched from the high-suction mode to the low-suction mode (in other words, the pressure in the negative pressure chamber 41 is switched from high negative pressure to low negative pressure).

In accordance with the printer 1 of this type (or in accordance with the printing method using the printer 1 of this type), the switching action is carried out in parallel with the printing action, and so it is not necessary to take time just for the switching action, and the overall printing action time can be shortened in comparison to the comparative example. Specifically, the operating period for a single job in this embodiment is the total of the time required for the printing action and the time required for the conveying operation. Relative to the operating period for the single job in the comparative example, the time is shortened by the time required for the switching action.

Controlling the rotation rate of the fan mechanism 42 in addition to controlling the ON/OFF of the fan mechanisms 42, 43 enables the interior of the negative pressure chamber 41 to be set to the desired negative pressure, and, as a result, the suction force on the roll paper R can be placed at the desired suction force. For example, in this embodiment, the interior of the negative pressure chamber 41 can be placed at the desired high negative pressure (desired high suction force) by operating the two fan mechanisms 42, 43 at 100% rotation rate in the high-suction mode, and the interior of the negative pressure chamber 41 can be placed at the desired low negative pressure (desired low suction pressure) by stopping the second fan mechanism 43 (0% rotation rate) and operating the first fan mechanism 42 at 65% rotation rate in the low-suction mode.

Thus, at the time of switching from high-suction mode to low-suction mode (TO in FIG. 5B, at initiation of the switching action), the controller 10 stops the second fan mechanism 43 and sets the rotation rate of the first fan mechanism 42 at a rotation rate in accordance with the suction force in low-suction mode (65% rotation rate in this case). In so doing, the pressure inside the negative pressure chamber 41 can be reliably transitioned from high negative pressure to low negative pressure by a simple control operation.

In addition, in this embodiment, the controller 10 initiates the switching action from the high-suction mode to the low-suction mode in the latter half of the printing action. For example, as shown in FIG. 5B, when printing of the image is to be completed on the sixth pass, the controller 10 switches from the high-suction mode to the low-suction mode after the fourth pass. Switching from the high-suction mode to the low-suction mode may be carried out between passes or during passes. As a result, the high-suction mode period during printing can be lengthened. In so doing, the roll paper R can be maintained in a flat state in the prescribed position on the platen 31 over a long time period during the printing action, making it possible to suppress degradation of image quality in the printed image (by preventing ink bleeding and contact with the head 33).

In addition, in this embodiment, the controller 10 initiates the switching action from the high-suction mode to the low-suction mode at time (T0) that is found by calculating backwards from the endpoint of the printing action (T1 in FIG. 5B) by the time required for the switching action (ta sec). In FIG. 5B, the time required for the switching action (ta sec) corresponds to the printing time of two passes, and the switching action is thus initiated at the time of initiation of the sixth pass. In addition, although an example was presented in which printing of the image was completed on the sixth pass, for example, the switching action can be initiated at the time of initiation of the third pass in cases where printing is completed on the fourth pass, or the switching action can be initiated at the time of initiation of the fifteenth pass when printing of the image is completed in sixteen passes. As a result, the time in the high-suction mode during the printing action can be additionally increased. In so doing, the roll paper R on the platen 31 can be held in a flat state at the prescribed position over a longer period of time during the printing action, thereby suppressing image degradation of the printed image.

The time required for the switching action from the high-suction mode to the low-suction mode (ta sec) should be determined when setting up the printer 1 (when different for each model of the printer 1) or at the time of production of the printer 1 (when different for each printer 1). However, there are cases where variation will occur in the time required for the switching action. Thus, in order to provide a margin for error, the switching action may be initiated at a time that is found by calculating backwards from the end point of the printing action (T1 in FIG. 5B) by the total time (ta+$\alpha$) of the time required for the switching action (ta sec) and the time differential ($\alpha$). In so doing, the conveying action can be carried out in a state in which the mode has been reliably switched from the high-suction mode to the low-suction mode.

In addition, there are cases in which periodic maintenance actions (discharge problem inspection/cleaning actions) are carried out subsequent to the printing action. As described above, by switching to the low-suction mode at the time of maintenance actions, vibration and noise can be reduced, and the accuracy of the discharge problem inspection can be increased. By switching from the high-suction mode to the low-suction mode during the printing action as in this embodiment, maintenance actions thus can be carried out soon after completion of the printing action. The overall printing action time thus can be reduced.

Modification Example

Figure 6A:
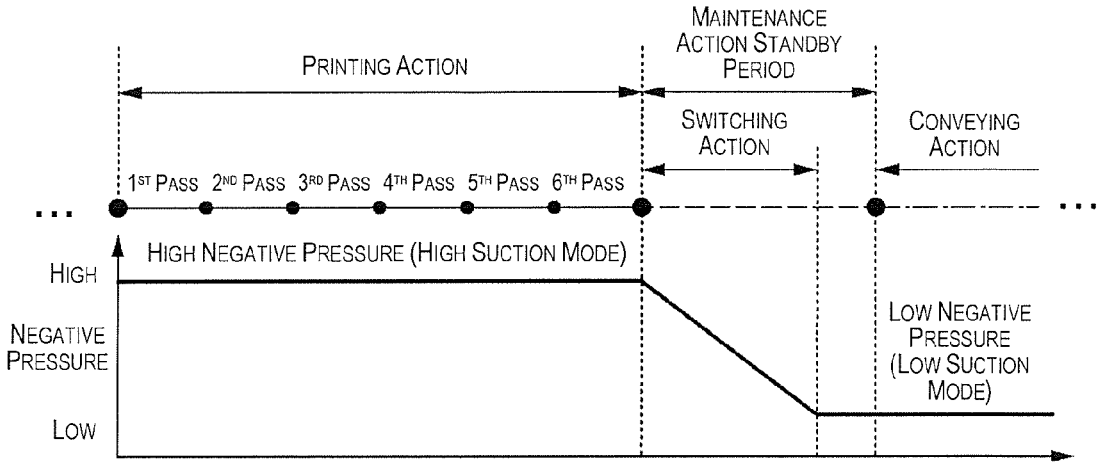
FIGS. 6A and 6B are diagrams for describing modification examples of the printing action.
Figure 6B:
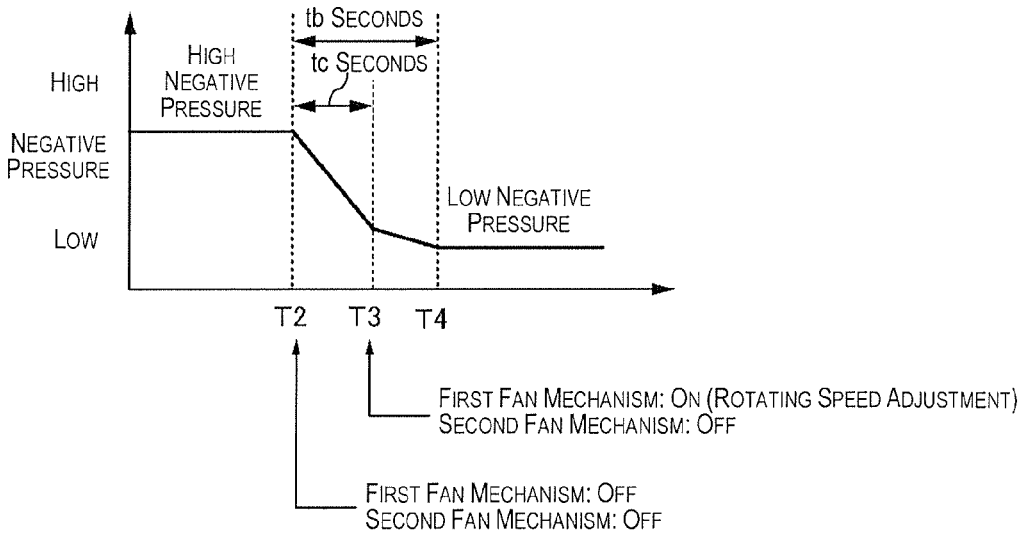

FIGS. 6A and 6B are diagrams for describing a modification example of the printing action. In the embodiment described above (FIG. 5B), an example was presented in which the conveying operation was carried out soon after the printing action, but the invention is not restricted to this example. There are cases in which the maintenance action is carried out periodically after the printing action, and the conveying action is subsequently performed. In addition, there are printers 1 in which a "wait period" during which no operation is being carried out is provided after a set number of repetitions of the printing action, or after all printing actions. With this type of printer 1, the wait period is provided after the printing action, and the conveying action is carried out after the wait period has passed.

In this modification example, the controller 10 does not switch from the high-suction mode to the low-suction mode during the printing action. Rather, as shown in FIG. 6A, the controller switches from the high-suction mode to the low-suction mode "during the maintenance action" which is the operation prior to the conveying action or "during the wait period." In so doing, the mode is set to the high-suction mode throughout the printing action, and the roll paper R can be held in a flat state at the prescribed position on the platen 31, so that degradation of image quality in the printed image can be suppressed. In addition, the overall printing action time can be shortened in comparison to cases in which the switching action is carried out after the printing action, which is then followed by the maintenance action or a wait period. Specifically, this is effective because the switching action is carried out in parallel with another operation (maintenance action or wait period). In FIG. 6A, the switching action is carried out simultaneously with regard to the maintenance action or initiation of the wait period, but the invention is not restricted to this example. For example, the switching action may be carried out in the latter half of the maintenance action or the wait period.

In addition, in the embodiment described above (FIG. 5B), the second fan mechanism 43 is stopped at the time of switching from the high-suction mode to the low-suction mode (at initiation of the switching action), and the rotation rate of the first fan mechanism 42 is set at a rotation rate in accordance with the suction force in the low-suction mode (65% rotation rate). However, the invention is not restricted to this embodiment.

For example, as shown in FIG. 6B, when the controller 10 switches from the high-suction mode to the low-suction mode (at initiation of the switching action, T2 in FIG. 6B), the two fan mechanisms 42, 43 are stopped (placed in an OFF state). After passage of a prescribed time (tc sec; at time T3), the rotation rate of the first fan mechanism 42 may be set to a rotation rate in accordance with the suction force in the low-suction mode (65% rotation rate).

In so doing, the two fan mechanisms 42, 43 are open to the atmosphere immediately after switching to the low-suction mode (T2 to T3), and the negative pressure in the negative pressure chamber 41 can be rapidly decreased (the pressure can be increased). Specifically, the two fan mechanisms 42, 43 (strictly speaking, the opening parts 41*d*, 41*e* of the negative pressure chamber 41 that communicate with the suction openings of the two fan mechanisms 42, 43) function as air holes immediately after switching to the low-suction mode. Next, after passage of a prescribed time (T3), the first fan mechanism 42 is made to operate at 65% rotation rate, and the negative pressure in the negative pressure chamber 41 can thereby be placed at a negative pressure corresponding to the low-suction mode.

The time required for the switching action in this modification example (tb sec in FIG. 6B) can be made shorter than the time required for the switching action in the embodiment described above (ta sec in FIG. 5B). Thus, in the operation prior to the conveying operation, the time in the high-suction mode can be additionally increased. If the operation prior to the conveying operation is the printing action, then the roll paper R can be held in a flat state in the prescribed position for a longer time, and degradation of the image quality of the printed image can be suppressed. The embodiment described above (FIG. 5B) allows easy control and stabilizes the transition from the high-suction mode to the low-suction mode.

In addition, in the above embodiment (FIG. 5B), switching from the high-suction mode to the low-suction mode is carried out during the operation prior to the conveying operation, but the invention is not restricted to this embodiment. As in the comparative example (FIG. 5A), the mode can be switched from the high-suction mode to the low-suction mode after completion of the operation prior to the conveying operation. In this case, if the operation prior to the conveying operation is the printing action, then the high-suction mode is maintained throughout the printing action, and so degradation in the quality of the printed image can be suppressed. In addition, in this case, the only the time for the switching action is set, and the invention thus becomes more effective in terms of shortening the switching time from the high-suction mode to the low-suction mode with the one fan mechanism 43 of the two fan mechanism 42, 43 stopped and the stopped fan mechanism 43 being utilized as an air hole in the low-suction mode.

Other Embodiments

In this embodiment, an image recording device was primarily described, but the invention also includes image recording methods and the like. The present embodiment was used in order to facilitate understanding of the invention and is not to be interpreted as limiting the invention. It should be understood that the invention can be changed and modified without departing from the scope of the invention, and that equivalent inventions are included in the invention. The embodiments described below, in particular, are included in the present invention.

Printer

In the embodiment described above, a printer 1 was cited as an example in which an image was printed on a roll paper R that was positioned in the print area while the head 33 was moved in the conveying direction and in the transverse direction with respect to roll paper R. However, the invention is not restricted to this example. For example, the printer may involve printing an image as the roll paper R passes under a fixed head 33.

In addition, the medium on which the image is recorded is not restricted to the roll paper R and may also be single-sheet paper. The image recording device may also involve recording the image on the medium by discharging a liquid other than ink from the nozzle.

The image recording device is not restricted to a printer. For example, a technology that is similar to the embodiment described above may be utilized in various types of devices that employ ink jet technologies, such as a device for producing color filters, a staining device, a micromachining device, a semiconductor production device, a surface processing device, a three-dimensional molding device, a gas vaporization device, an organic EL production device (in particular a macromolecular EL production device), a display production device, a filming device, or a DNA chip production device. The methods associated therewith and/or the methods for manufacturing same also fall into the category of application.

General Interpretation of Terms

In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives. Also, the terms "part," "section," "portion," "member" or "element" when used in the singular can have the dual meaning of a single part or a plurality of parts. Finally, terms of degree such as "substantially", "about" and "approximately" as used herein mean a reasonable amount of deviation of the modified term such that the end result is not significantly changed. For example, these terms can be construed as including a deviation of at least ±5% of the modified term if this deviation would not negate the meaning of the word it modifies.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing descriptions of the embodiments according to the present invention are provided for illustration only, and not for the purpose of limiting the invention as defined by the appended claims and their equivalents.

What is claimed is:

1. An image recording device comprising:

a recording part configured and arranged to record an image on a medium;

a conveying part configured and arranged to convey the medium;

a medium support part configured and arranged to support the medium on a support surface provided with openings of suction holes;

a suction part configured and arranged to suction the medium supported on the medium support part via the suction holes, the suction part having a negative pressure chamber communicating with the suction holes and at least two air-blowing parts whereby air in an interior of the negative pressure chamber is discharged and a negative pressure is produced inside the negative pressure chamber, the air-blowing parts being attached at different positions on an outer surface of the negative pressure chamber; and a control part configured to switch between a first mode in which a suction force of the suction part on the medium is set to a first suction force and a second mode in which the suction force is set to a second suction force that is lower than the first suction force, the control part being configured to stop one of the air-blowing parts in the second mode, the conveying part performing repeatedly conveying the medium and stopping the conveying of the medium, the recording part recording the image on the medium while the conveying of the medium is stopped, the control part switching between the first mode and the second mode, such that the suction part suctions the medium with the first suction force while the conveying of the medium is stopped, and such that the suction part suctions the medium with the second suction force while the medium is conveyed.

2. The image recording device according to claim 1, wherein a volume of air passing through an opening part of the negative pressure chamber communicating with a suction opening of a first air-blowing part among the air-blowing parts is greater than a volume of air passing through an opening part of the negative pressure chamber communicating with a suction opening of the other of the air-blowing parts.

3. The image recording device according to claim 2, wherein the control part is configured to stop the first air-blowing part during the second mode.

4. The image recording device according to claim 2, wherein the one of the air-blowing parts includes at least two air-blowing mechanisms aligned in series.

5. The image recording device according to claim 1, wherein the control part is configured to switch from the first mode to the second mode during an action of recording the image on the medium as performed by the recording part.

6. The image recording device according to claim 1, wherein the air-blowing parts are attached directly or indirectly to the medium support part.

7. An image recording method for recording an image on a medium by an image recording device including:

a recording part configured and arranged to record an image on a medium;

a conveying part configured and arranged to convey the medium;

a medium support part configured and arranged to support the medium on a support surface provided with openings of suction holes;

a suction part configured and arranged to suction the medium supported on the medium support part via the suction holes, the suction part having a negative pressure chamber communicating with the suction holes and at least two air-blowing parts whereby air in an interior of the negative pressure chamber is discharged and a negative pressure is produced inside the negative pressure chamber, the air-blowing parts being attached at different positions on an outer surface of the negative pressure chamber; and a control part configured to switch between a first mode in which a suction force of the suction part on the medium is set to a first suction force and a second mode in which the suction force is set to a second suction force that is lower than the first suction force, the control part being configured to stop one of the air-blowing parts in the second mode, the conveying part performing repeatedly conveying the medium and stopping the conveying of the medium, the recording part recording the image on the medium while the conveying of the medium is stopped, the control part switching between the first mode and the second mode, such that the suction part suctions the medium with the first suction force while the conveying of the medium is stopped, and such that the suction part suctions the medium with the second suction force while the medium is conveyed, the image recording method comprising:

recording the image on the medium by using the image recording device.

* * * * *